US010989192B2

(12) United States Patent
Schroeder et al.

(10) Patent No.: US 10,989,192 B2
(45) Date of Patent: Apr. 27, 2021

(54) AUTOMOTIVE ELECTRICAL OIL PUMP

(71) Applicant: PIERBURG PUMP TECHNOLOGY GMBH, Neuss (DE)

(72) Inventors: Viktor Schroeder, Leghorn (IT); Alessandro Malvasi, Leghorn (IT); Andreas Wulf, Duesseldorf (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 185 days.

(21) Appl. No.: 16/068,899

(22) PCT Filed: Jan. 12, 2016

(86) PCT No.: PCT/EP2016/050460

§ 371 (c)(1),
(2) Date: Jul. 10, 2018

(87) PCT Pub. No.: WO2017/121463

PCT Pub. Date: Jul. 20, 2017

(65) Prior Publication Data

US 2019/0017505 A1 Jan. 17, 2019

(51) Int. Cl.

| | |
|---|---|
| ***F04C 15/06*** | (2006.01) |
| ***F04C 2/10*** | (2006.01) |
| ***F01M 1/02*** | (2006.01) |

(52) U.S. Cl.

CPC ..... *F04C 15/06* (2013.01); *F04C 2/102* (2013.01); *F01M 2001/0215* (2013.01);
(Continued)

(58) Field of Classification Search

CPC F04C 2/10–103; F04C 15/06; F04C 2240/30; F04C 2250/10; F04B 17/03;
(Continued)

(56) References Cited

U.S. PATENT DOCUMENTS 3,791,765 A * 2/1974 Hansen ..... F04C 15/00 417/357
4,662,827 A * 5/1987 Wiernicki ..... F02M 37/08 417/363

(Continued)

FOREIGN PATENT DOCUMENTS

JP S6298095 * 5/1987

*Primary Examiner* — Alexander B Comley
(74) *Attorney, Agent, or Firm* — Norman B. Thot

(57) ABSTRACT

An automotive electrical oil pump which includes an oil displacement pumping unit with a pump rotor which rotates in a pump chamber to pump oil to an oil recipient, an electric driving motor which drives the pump rotor, an electrical connector plug which connects the electric driving motor to a power source, and a fluid connector. The fluid connector includes a pump inlet fluidically connected to a chamber inlet, a pump outlet fluidically connected to a chamber outlet, a first lateral circular ring opening which define the pump inlet or the pump outlet, and a second lateral circular ring opening or a circular front opening which defines the pump outlet or the pump inlet. The second lateral circular ring opening is provided separate from the first lateral circular ring opening. The pump outlet and the pump inlet are arranged coaxially to each other.

18 Claims, 6 Drawing Sheets

(52) U.S. Cl.
CPC .. *F01M 2001/0238* (2013.01); *F04C 2240/30* (2013.01); *F04C 2250/10* (2013.01)

(58) Field of Classification Search
CPC ..... F04B 53/16; F04D 29/406; F04D 29/426–4293; F01M 2001/0215; F01M 2001/0238
USPC ..... 418/61.3, 68
See application file for complete search history.

(56) References Cited

U.S. PATENT DOCUMENTS

| | | | | |
|---|---|---|---|---|
| 5,145,329 | A * | 9/1992 | Zumbusch | F02M 37/041 417/356 |
| 2006/0024176 | A1 | 2/2006 | Ikeya | |
| 2010/0130327 | A1 | 5/2010 | Morgan, Jr. | |
| 2010/0290934 | A1 * | 11/2010 | Hadar | F04C 2/102 417/410.4 |
| 2014/0056696 | A1 * | 2/2014 | Kawano | F04D 27/002 415/145 |

* cited by examiner

AUTOMOTIVE ELECTRICAL OIL PUMP

CROSS REFERENCE TO PRIOR APPLICATIONS

This application is a U.S. National Phase application under 35 U.S.C. § 371 of International Application No. PCT/EP2016/050460, filed on Jan. 12, 2016. The International Application was published in English on Jul. 20, 2017 as WO 2017/121463 A1 under PCT Article 21(2).

FIELD

The present invention relates to an automotive electrical oil pump.

BACKGROUND

The automotive electrical oil pump comprises an oil displacement pumping unit comprising a pump rotor rotating in a pump chamber for pumping pressurized oil to an oil recipient. The oil pump further comprises an electric driving motor for driving the pump rotor of the pumping unit, an electrical connector plug for electrically connecting the driving motor to a power source, and a fluid connector comprising a pump inlet and a pump outlet which are fluidically connected to a corresponding chamber inlet and chamber outlet of the pump chamber.

Such an automotive electrical oil pump has previously been described. However, the previously described automotive electrical oil pumps have disadvantages. The oil pump must be arranged in a specific rotational position in order to make a good fluidic connection between the pump inlet and the pump outlet of the fluid connector with the corresponding openings of a counter fluid connector. The orientation of the electrical connector, which is usually arranged with a radial plugging direction, is dependent on the orientation of the counter fluid connector. Every automotive manufacturer demands another orientation of the counter fluid connector and of the counter electrical connector. The pump supplier therefore needs many different pump versions to comply with the different required connector orientations.

SUMMARY

An aspect of the present invention is to provide an automotive electrically driven oil pump which is flexible with respect to different mounting conditions.

In an embodiment, the present invention provides an automotive electrical oil pump which includes an oil displacement pumping unit comprising a pump rotor which is configured to rotate in a pump chamber so as to pump a pressurized oil to an oil recipient, an electric driving motor configured to drive the pump rotor of the oil displacement pumping unit, an electrical connector plug configured to electrically connect the electric driving motor to a power source, and a fluid connector. The fluid connector comprises a pump inlet which is fluidically connected to a chamber inlet, a pump outlet which is fluidically connected to a chamber outlet, a first lateral circular ring opening which is configured to define the pump inlet or the pump outlet, and a second lateral circular ring opening or a circular front opening which is configured to define the pump outlet or the pump inlet. The second lateral circular ring opening is provided separate from the first lateral circular ring opening. The pump outlet and the pump inlet are arranged coaxially to each other.

BRIEF DESCRIPTION OF THE DRAWINGS

The present invention is described in greater detail below on the basis of embodiments and of the drawings in which.

DETAILED DESCRIPTION

Figure 1:
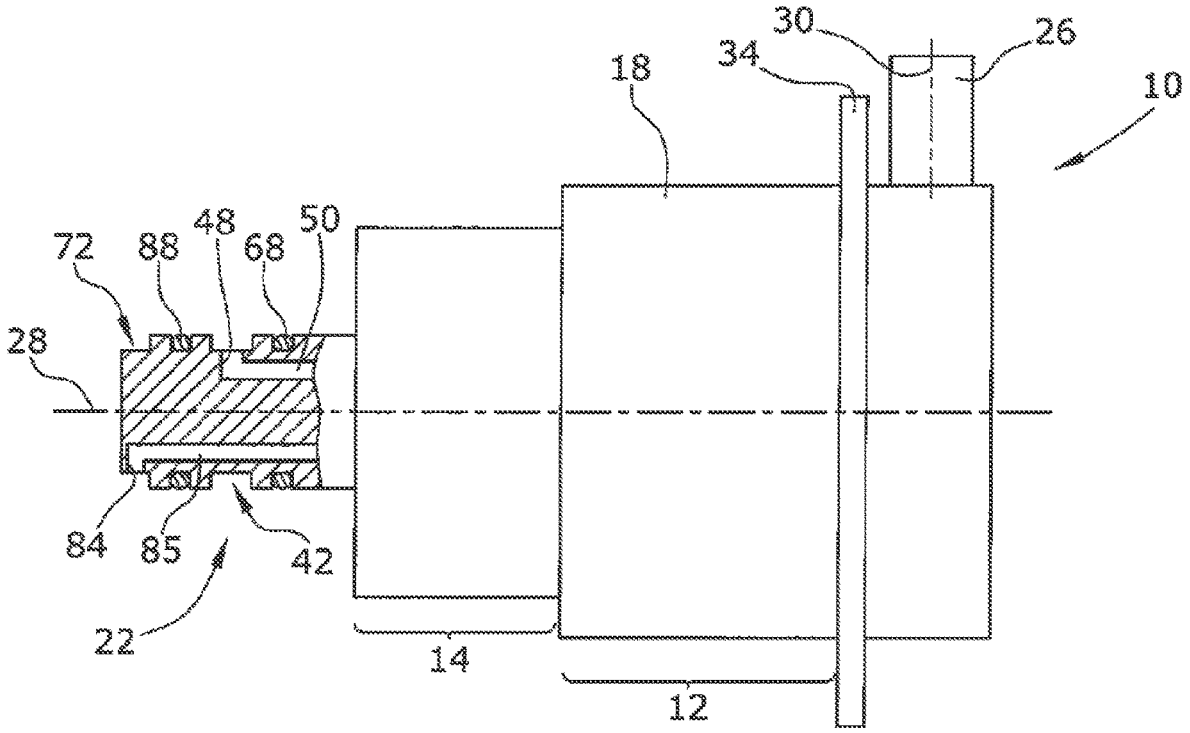
FIG. 1 shows, in part, a longitudinal section of an automotive electric oil pump according to the present invention.

According to the present invention, the fluid connector comprises at least one first lateral circular ring opening defining the pump inlet or the pump outlet. The fluid connector further comprises a separate second lateral circular ring opening or a circular front opening defining the pump outlet or the pump inlet, wherein the pump outlet and the pump inlet are arranged coaxially to each other. A lateral opening according to the present invention is an opening which is arranged so that the opening substantially opens in a radial direction of the pump. A fluid connector is provided having a pump inlet and a pump outlet which is rotationally symmetric via the respective coaxial arrangement of the first lateral circular ring opening and the separate second lateral ring opening or the circular front opening. During the mounting process, the pump is thereby rotatable around the axis of the circular front opening or the second lateral circular ring opening. The pump can accordingly be rotated during mounting so that the electrical connector plug is positioned as required by the automotive manufacturer. The pump is accordingly flexible with respect to different mounting conditions. Only one pump version is thus necessary to fulfill the different requirements of the automotive manufacturers.

In an embodiment of the present invention, the fluid connector can, for example, be formed as a cylindrical body, wherein the pump inlet and the pump outlet are defined by the lateral circular ring openings at an outer circumferential surface of the cylindrical body. The inventive arrangement of the ring openings provide a fluid connector having a pump inlet and a pump outlet which are both rotationally symmetric. The pump is thereby rotatable around the axis of the cylindrical body as long as the pump is not finally fixed to the counter fluid connector but is already plugged to the counter fluid connector. After plugging, the pump can be rotated so that the electrical connector plug is rotationally positioned as required by the automotive manufacturer. The pump can accordingly be used in all different rotational orientations between the plugging direction of the electrical connector and the openings of the counter fluid connector. Only one pump version is thus sufficient for fulfilling the different requirements of the automotive manufacturers.

In an embodiment of the present invention, the fluid connector can, for example, be formed as a cylindrical body, wherein the pump inlet or the pump outlet is arranged at a free axial end face of the cylindrical body. The pump is thereby also usable if the counter inlet or the counter outlet is provided in an axial direction.

In an embodiment of the present invention, the cylindrical body can, for example, comprise a first axial channel connecting the pump inlet with the chamber inlet and a second axial channel connecting the pump outlet with the chamber outlet. The orientation of the first axial channel and the second axial channel must thereby be understood as not necessarily being strictly axial but substantially axial. The first and the second axial channel have the effect that the lateral circular ring openings can be provided with an axial distance to the pumping unit.

In an embodiment of the present invention, the pump inlet and the pump outlet of the fluid connector can, for example, both be arranged coaxially to a rotation axis of the driving motor. The axis for rotating the pump into a suitable rotational mounting position is substantially in the center of the pump. The pump accordingly requires a minimum of mounting space when being rotated to the required plugging direction of the electrical connector plug.

In an embodiment of the present invention, the electrical connector plug can, for example, be arranged radially with a substantially radial plugging direction with respect to the motor rotation axis. As the electrical counter connector plug is usually provided in a radial plugging direction, the electrical connector plug can be provided according to the requirements of the automotive manufacturers.

In an embodiment of the present invention, the pumping unit can, for example, be defined by a gerotor assembly. The gerotor operates very quietly. The gerotor can also be operated in both rotational directions so that the pump inlet and the pump outlet can be simply exchanged by changing the rotational direction of the pump. No second version of the pump is necessary if the pump inlet and the pump outlet must be changed.

In an embodiment of the present invention, the pump inlet can, for example, be arranged axially distal of the pump outlet. The pump outlet can alternatively be arranged axially distal of the pump inlet. These features have the effect that the pump outlet and the pump inlet of the fluid connector can be adapted to the requirements of the automotive manufacturer.

In an embodiment of the present invention, the ring opening providing the pump inlet can, for example, be arranged at an edge of the distal end of the fluid connector. The ring opening providing the pump outlet can alternatively be arranged at an edge of the distal end of the fluid connector. The respective counter inlet or outlet connector can be provided either on a lateral side of the counter fluid connector or on an axial side of the counter fluid connector.

In an embodiment of the present invention, the ring openings can, for example, be fluidically sealed by at least one flexible radial sealing ring provided at an outer circumferential surface of the fluid connector. The drawbacks of an axial sealing are thereby avoided. The sealing quality of an axial sealing strongly depends on the axial connection of the pump. The sealing quality can be reduced by an axial overload caused by the mounting process damaging the sealing ring. The sealing quality can also be reduced due to a an axial fixation of the pump which is too loose. These drawbacks can be overcome using radial sealing rings.

A detailed description of embodiments of the present invention is set forth below under reference to the drawings.

FIG. 1 shows, in part, a longitudinal section of an automotive electric oil pump 10. The oil pump 10 comprises an electric driving motor 12 driving the pumping unit 14, both being provided in a pump housing 18. A fluid connector 22 is arranged at an axial front end, which is axially opposite of the driving motor 12. The fluid connector 22 is connectable to a corresponding fluid counter connector (not shown in the drawings) of, for example, an automotive engine, a transmission, a heat-exchanger etc. so as to fluidically connect the oil pump 10 with an oil recipient, namely, the engine, the transmission, the heat-exchanger etc. An electrical connector plug 26 is arranged at an axial pump end opposite to the axial end with the fluid connector 22. The electrical connector plug 26 is arranged with a radial plugging direction 30 with respect a rotation axis 28 of the driving motor 12. A flange portion 34 is arranged at an axial end of the oil pump 10 for mechanically connecting the oil pump 10 to a corresponding counterpart.

Figure 2:
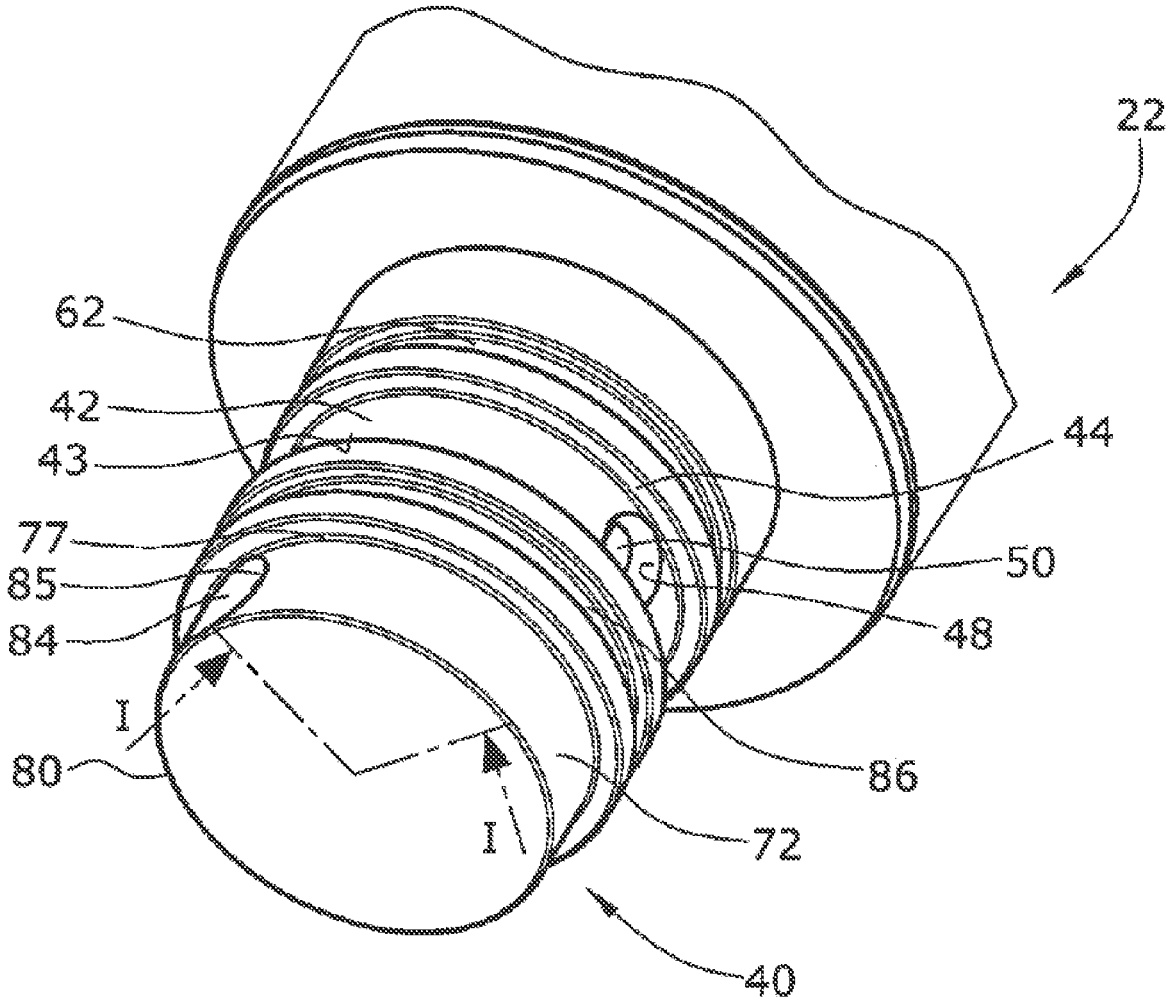
FIG. 2 shows a perspective view of the fluid connector of the pump according to FIG. 1 where the second lateral circular ring groove defines the pump inlet, and where the second lateral circular ring groove is arranged at an edge of a distal end of the fluid connector.

FIG. 2 shows the fluid connector 22 of the oil pump 10 in more detail. The fluid connector 22 is formed as a cylindrical body 40 and extends in an axial direction of the oil pump 10. A first lateral circular ring opening 42 is arranged at an outer circumferential surface 43 of the cylindrical body 40 defining a pump outlet 44 through which the pressurized fluid is emitted. A first intermediate opening 48 is arranged in the first lateral circular ring opening 42, which first intermediate opening 48 fluidically connects the pump unit 14 with the first lateral circular ring opening 42 via a first axial channel 50. A first wall groove 62 is provided at the outer circumferential surface 43 of the cylindrical body 40, at a proximal side thereof, to receive a radial sealing 68 which is a first O-ring.

The fluid connector 22 further comprises a second lateral circular ring opening 72 which is arranged coaxially to the first lateral circular ring opening 42, which second lateral circular ring opening 72 defines the pump inlet 77. The second lateral circular ring opening 72 is arranged at a distal edge 80 of the cylindrical body 40. The second lateral circular ring opening 72 is adjacent to but spaced apart from the first lateral circular ring opening 42 in an axial direction. A second intermediate opening 84 is arranged in the second lateral circular ring opening 72, which intermediate opening 84 fluidically connects the pump unit 14 with the second lateral circular ring opening 72 via a second axial channel 85. The second intermediate opening 84 is adjacent to but spaced apart from the first intermediate opening 48 in a circumferential direction. A second wall groove 86 is provided at the outer circumferential surface 43 of the cylindrical body 40 between the first lateral circular ring opening 42 and the second lateral circular ring opening 72 to receive a radial sealing 88 which is a second O-ring.

Figure 3:
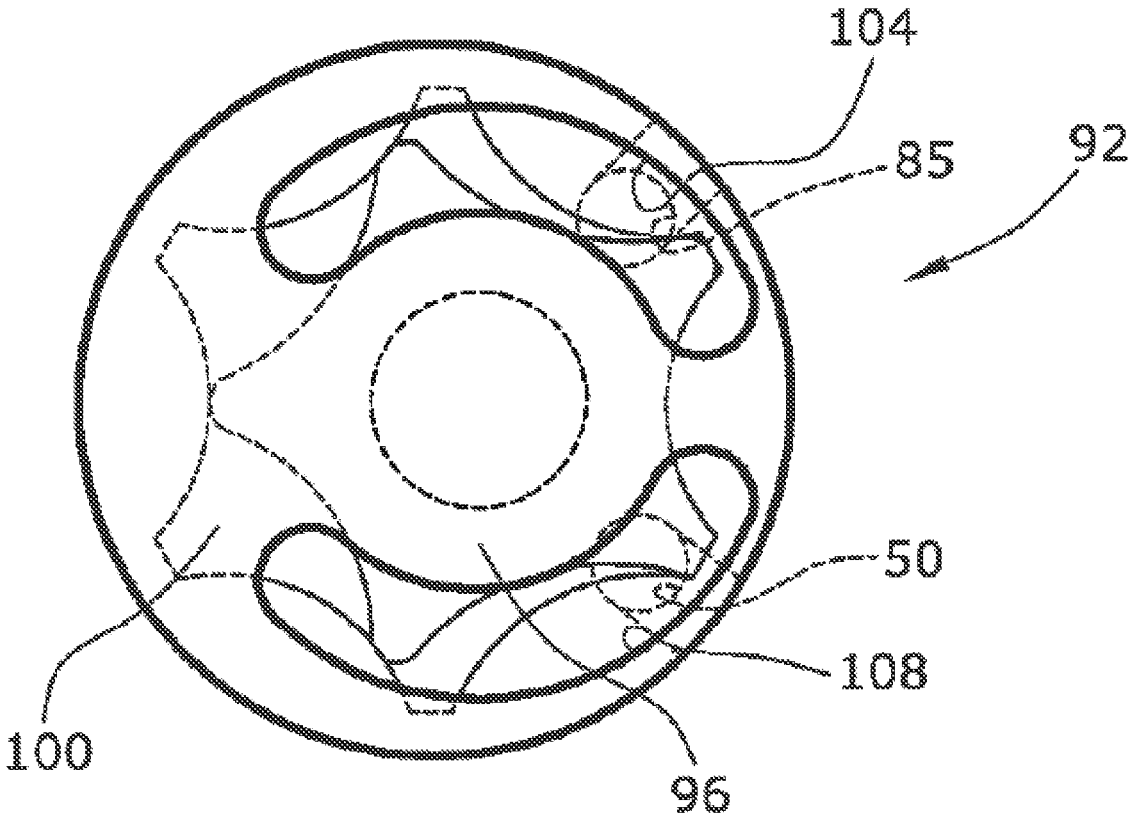
FIG. 3 shows a top view on the pumping unit.

FIG. 3 shows a top view of a gerotor assembly 92 defining the pumping unit 14 in the oil pump 10. The gerotor assembly 92 comprises a pump rotor 96 rotating in a pump chamber 100. A kidney-shaped chamber inlet 104 is provided at an axial side of the gerotor assembly 92 through which the fluid is sucked into the gerotor assembly 92. A kidney-shaped chamber outlet 108 is provided through which pressurized fluid is emitted on the same axial side of the gerotor assembly 92 but radially substantially opposite to the chamber inlet 104. The chamber outlet 108 is fluidically connected with the first lateral circular ring opening 42 via the first axial channel 50, whereas the chamber inlet 104 is fluidically connected with the second lateral circular ring opening 72 via the second axial channel 85.

Figure 4:
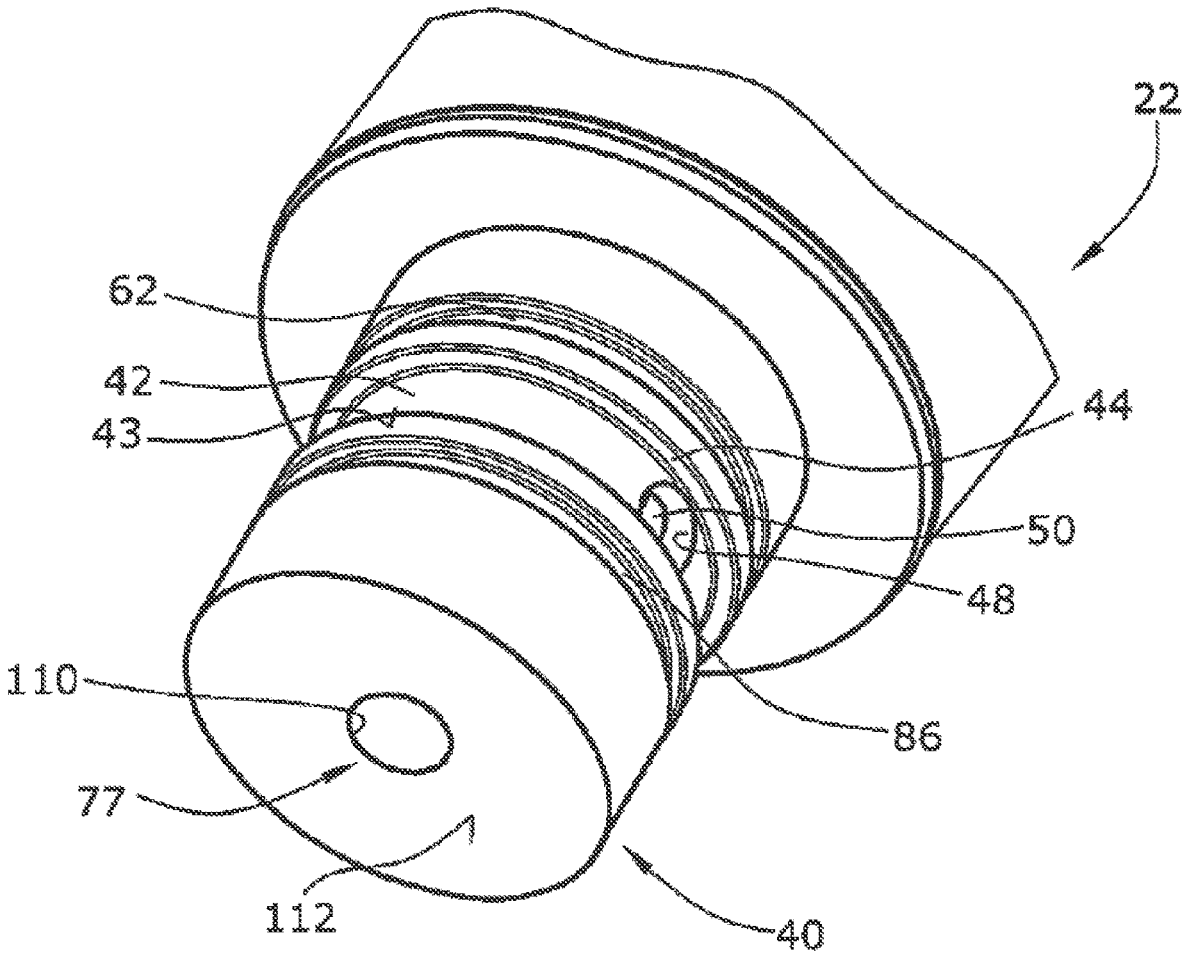
FIG. 4 shows an embodimetn where the pump inlet is positioned at the free axial end face of the oil pump.
Figure 5:
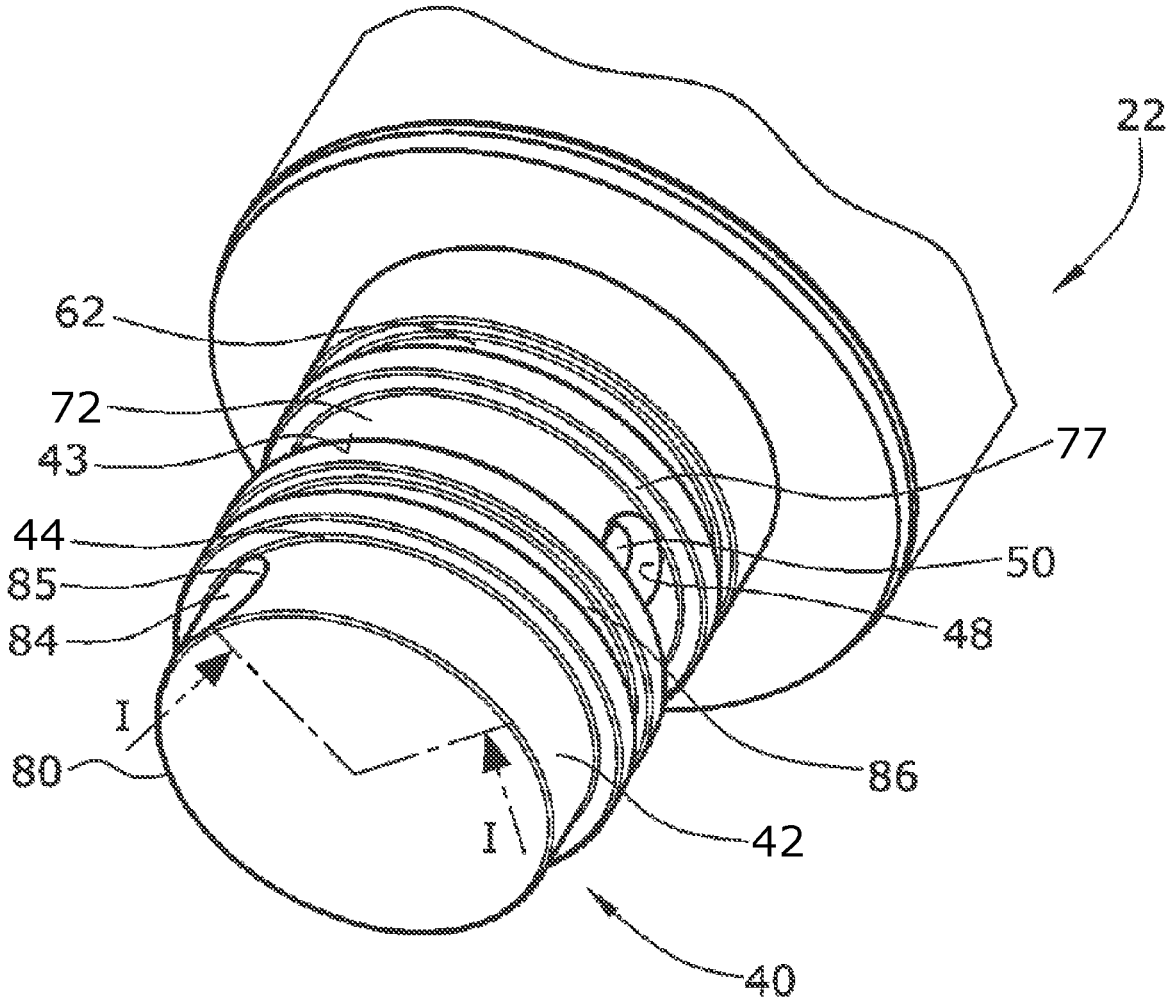
FIG. 5 shows a perspective view of the fluid connector of the pump according to FIG. 1 where the first lateral circular ring groove defines the pump outlet, and where the first lateral circular ring groove is arranged at an edge of a distal end of the fluid connector of claim.
Figure 6:
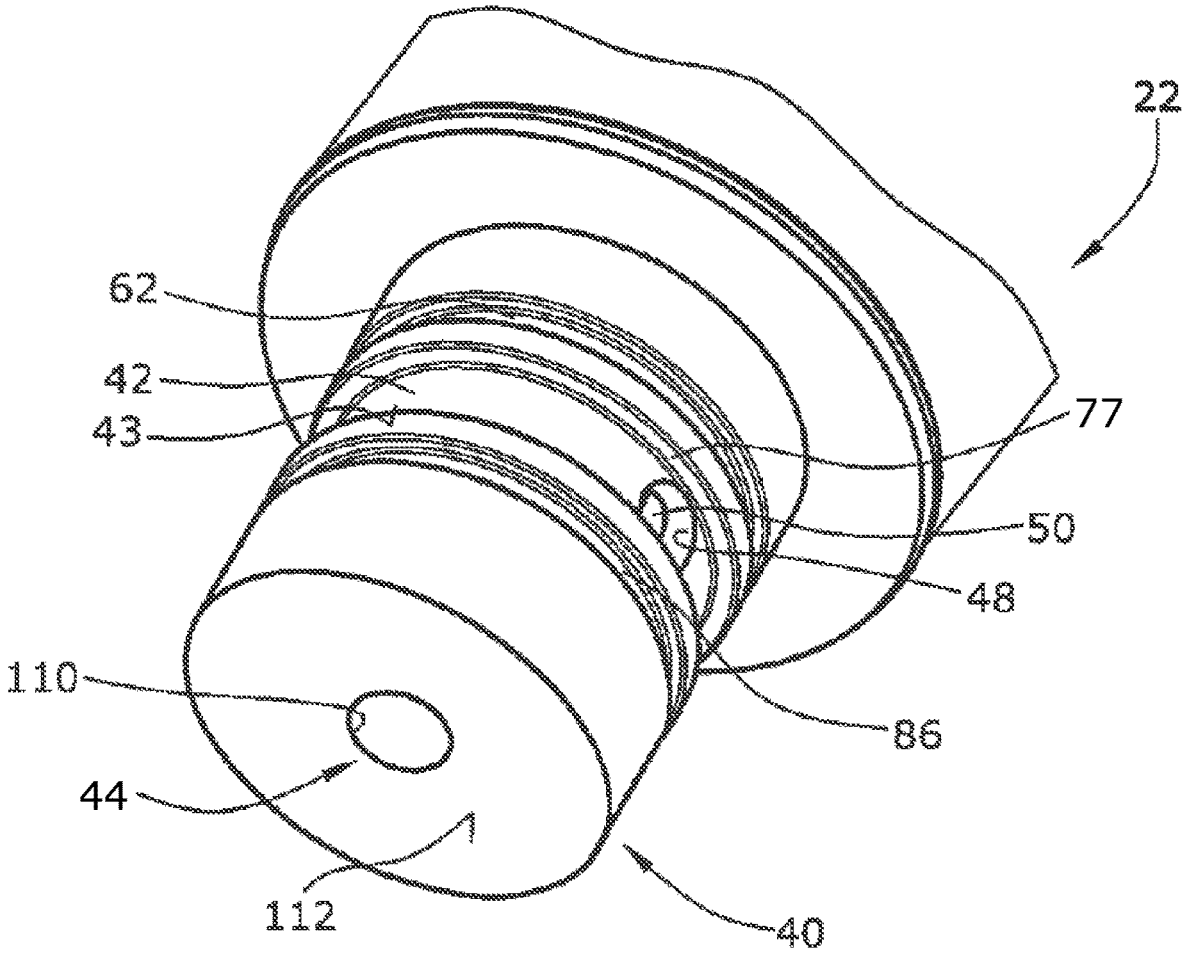
FIG. 6 shows an embodiment where the pump outlet is positioned at the free axial end face.

FIG. 4 shows the fluid connector 22 of the oil pump 10 according to a second embodiment. The fluid connector 22 according to this embodiment differs from the embodiment shown in FIG. 2 in that a circular front opening 110 defining, for example, the pump inlet 77 is arranged at a free axial end face 112 of the cylindrical body 40.

It should be clear from the above that the automotive electrical oil pump is not limited to the above described embodiments. Other pumping units than a gerotor can in particular be used. Other designs of the pump housing or the gerotor are also conceivable. Reference should also be had to the appended claims.

REFERENCE NUMERALS

10 automobile electric oil pump
12 electric driving motor
14 pumping unit
18 pump housing
22 fluid connector
26 electrical connector plug
28 rotation axis
30 radial plugging direction
34 flange portion
40 cylindrical body
42 first lateral circular ring opening
43 outer circumferential surface
44 pump outlet
48 first intermediate opening
50 first axial channel
62 first wall groove
68 radial sealing
72 second lateral circular ring opening
77 pump inlet
80 distal edge
84 second intermediate opening
85 second axial channel
86 second wall groove
88 radial sealing
92 gerotor assembly
96 pump rotor
100 pump chamber
104 chamber inlet
108 chamber outlet
110 circular front opening
112 free axial end face

What is claimed is:

1. An automotive electrical oil pump comprising:

an oil displacement pumping unit comprising a pump rotor which is configured to rotate in a pump chamber so as to pump a pressurized oil to an oil recipient;

an electric driving motor configured to drive the pump rotor of the oil displacement pumping unit, the electric driving motor comprising a rotation axis;

an electrical connector plug configured to electrically connect the electric driving motor to a power source; and a fluid connector comprising, a pump inlet which is fluidically connected to a chamber inlet, a pump outlet which is fluidically connected to a chamber outlet, a first lateral circular ring groove which is configured to define the pump inlet or the pump outlet, and a second lateral circular ring groove which is configured to define the pump outlet or the pump inlet, the second lateral circular ring groove being provided separate from the first lateral circular ring groove, wherein, the first lateral circular ring groove defines the pump inlet and the second lateral circular ring groove defines the pump outlet, or the first lateral circular ring groove defines the pump outlet and the second lateral circular ring groove defines the pump inlet, the pump outlet and the pump inlet are arranged coaxially to each other, the pump inlet and pump outlet of the fluid connector are both arranged coaxially to the rotation axis of the electric driving motor, the fluid connector is formed as a cylindrical body comprising an outer circumferential surface, and the pump inlet and the pump outlet are defined at the outer circumferential surface of the cylindrical body.

2. The automotive electrical oil pump as recited in claim 1, wherein the cylindrical body further comprises a first axial channel which is configured to connect the pump inlet with the chamber inlet and a second axial channel which is configured to connect the pump outlet with the chamber outlet.

3. The automotive electrical oil pump as recited in claim 1, wherein the electrical connector plug is arranged radially with a plugging direction which is substantially radial with respect to the rotation axis.

4. The automotive electrical oil pump as recited in claim 1, wherein the oil displacement pumping unit is defined by a gerotor assembly wherein at least one of the chamber inlet and the chamber outlet is eccentric.

5. The automotive electrical oil pump as recited in claim 1, wherein the pump inlet is arranged axially distal of the pump outlet.

6. The automotive electrical oil pump as recited in claim 5, wherein the second lateral circular ring groove is configured to define the pump inlet, and the second lateral circular ring groove is arranged at an edge of a distal end of the fluid connector.

7. The automotive electrical oil pump as recited in claim 1, wherein the pump outlet is arranged axially distal of the pump inlet.

8. The automotive electrical oil pump as recited in claim 7, wherein the second lateral circular ring groove is configured to define the pump outlet, and the second lateral circular ring groove is arranged at an edge of a distal end of the fluid connector.

9. The automotive electrical oil pump as recited in claim 1, wherein the first lateral circular ring groove and the second lateral circular ring groove are each fluidically sealed by at least one flexible radial sealing ring which is arranged at the outer circumferential surface of the fluid connector.

10. An automotive electrical oil pump comprising:

an oil displacement pumping unit comprising a pump rotor which is configured to rotate in a pump chamber so as to pump a pressurized oil to an oil recipient;

an electric driving motor configured to drive the pump rotor of the oil displacement pumping unit, the electric driving motor comprising a rotation axis;

an electrical connector plug configured to electrically connect the electric driving motor to a power source; and a fluid connector comprising, a pump inlet which is fluidically connected to a chamber inlet, a pump outlet which is fluidically connected to a chamber outlet, a first lateral circular ring groove which is configured to define the pump inlet or the pump outlet, and a circular front opening which is configured to define the pump outlet or the pump inlet, the circular front opening being provided separate from the first lateral circular ring groove, wherein, the first lateral circular ring groove defines the pump inlet and the circular front opening defines the pump outlet, or the first lateral circular ring groove defines the pump outlet and the circular front opening defines the pump inlet, the pump outlet and the pump inlet are arranged coaxially to each other, the pump inlet and pump outlet of the fluid connector are both arranged coaxially to the rotation axis of the electric driving motor, the fluid connector is formed as a cylindrical body comprising an outer circumferential surface, and the pump inlet or the pump outlet is defined by the first lateral circular ring groove at the outer circumferential surface of the cylindrical body.

11. The automotive electrical oil pump as recited in claim 10, wherein the pump inlet or the pump outlet is arranged at a free axial end face of the cylindrical body.

12. The automotive electrical oil pump as recited in claim 10, wherein the cylindrical body further comprises a first axial channel which is configured to connect the pump inlet with the chamber inlet and a second axial channel which is configured to connect the pump outlet with the chamber outlet.

13. The automotive electrical oil pump as recited in claim 10, wherein the electrical connector plug is arranged radially with a plugging direction which is substantially radial with respect to the rotation axis.

14. The automotive electrical oil pump as recited in claim 10, wherein the oil displacement pumping unit is defined by a gerotor assembly wherein at least one of the chamber inlet and the chamber outlet is eccentric.

15. The automotive electrical oil pump as recited in claim 10, wherein the pump inlet is arranged axially distal of the pump outlet.

16. The automotive electrical oil pump as recited in claim 15, wherein the circular front opening is configured to define the pump inlet.

17. The automotive electrical oil pump as recited in claim 10, wherein the pump outlet is arranged axially distal of the pump inlet.

18. The automotive electrical oil pump as recited in claim 10, wherein the first lateral circular ring groove and the circular front opening are each fluidically sealed by at least one flexible radial sealing ring which is arranged at the outer circumferential surface of the fluid connector.

* * * * *